United States Patent [19]

Kiminki et al.

[11] 4,029,515

[45] June 14, 1977

[54] ACID HYDROLYSIS OF POLYSACCHARIDE-CONTAINING RAW MATERIAL

[75] Inventors: Keijo Kiminki; Raili Kulmala; Seppo Sipilä, all of Pori, Finland

[73] Assignee: Oy. W. Rosenlew Ab, Pori, Finland

[22] Filed: Sept. 19, 1975

[21] Appl. No.: 615,037

[30] Foreign Application Priority Data

Oct. 4, 1974 Finland ..... 742911

[52] U.S. Cl. ..... 127/37; 127/1

[51] Int. Cl.[2] ..... C13K 1/02; C13K 13/00

[58] Field of Search ..... 127/37, 1

[56] References Cited

UNITED STATES PATENTS

| | | | |
|---|---|---|---|
| 1,428,217 | 9/1922 | Classen | 127/37 |
| 1,687,785 | 10/1928 | Perl | 127/37 |
| 1,806,531 | 5/1931 | Gogarten | 127/37 |
| 1,828,982 | 10/1931 | Perl | 127/37 |
| 1,963,972 | 6/1934 | Dreyfus | 127/37 |
| 2,488,981 | 11/1949 | Marchiaro | 127/37 X |
| 3,523,911 | 8/1970 | Funk | 127/37 X |
| 3,701,789 | 10/1972 | Ramos-Rodriguez | 127/37 X |

*Primary Examiner*—Sidney Marantz
*Attorney, Agent, or Firm*—Ladas, Parry, Von Gehr, Goldsmith & Deschamps

[57] ABSTRACT

A continuous method for the decomposition of a raw-material that contains polysaccharides by means of acid hydrolysis. The raw-material is hydrolyzed continuously in one reactor as two steps. In the first step, the hydrolysis is run in the upper part of the reactor in a vapor phase, whereby pentosans are decomposed mainly into furfural, acetic acid, methanol, and acetone, and hexosans are decomposed into disaccharides and trisaccharides. In the second step, the hydrolysis is run in the bottom part of the reactor in a liquid phase, whereby the disaccharides and trisaccharides obtained in the first step are decomposed into monosaccharides and into saccharic and fatty acids.

7 Claims, 1 Drawing Figure

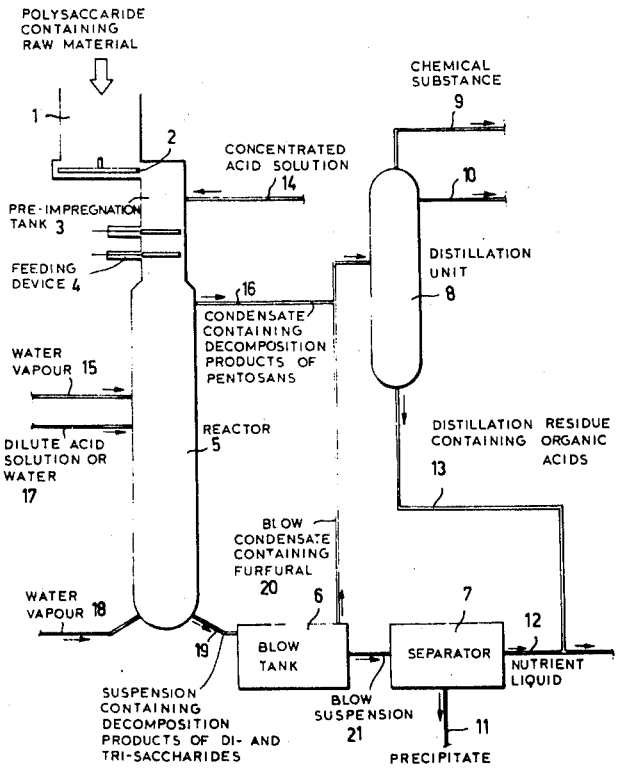

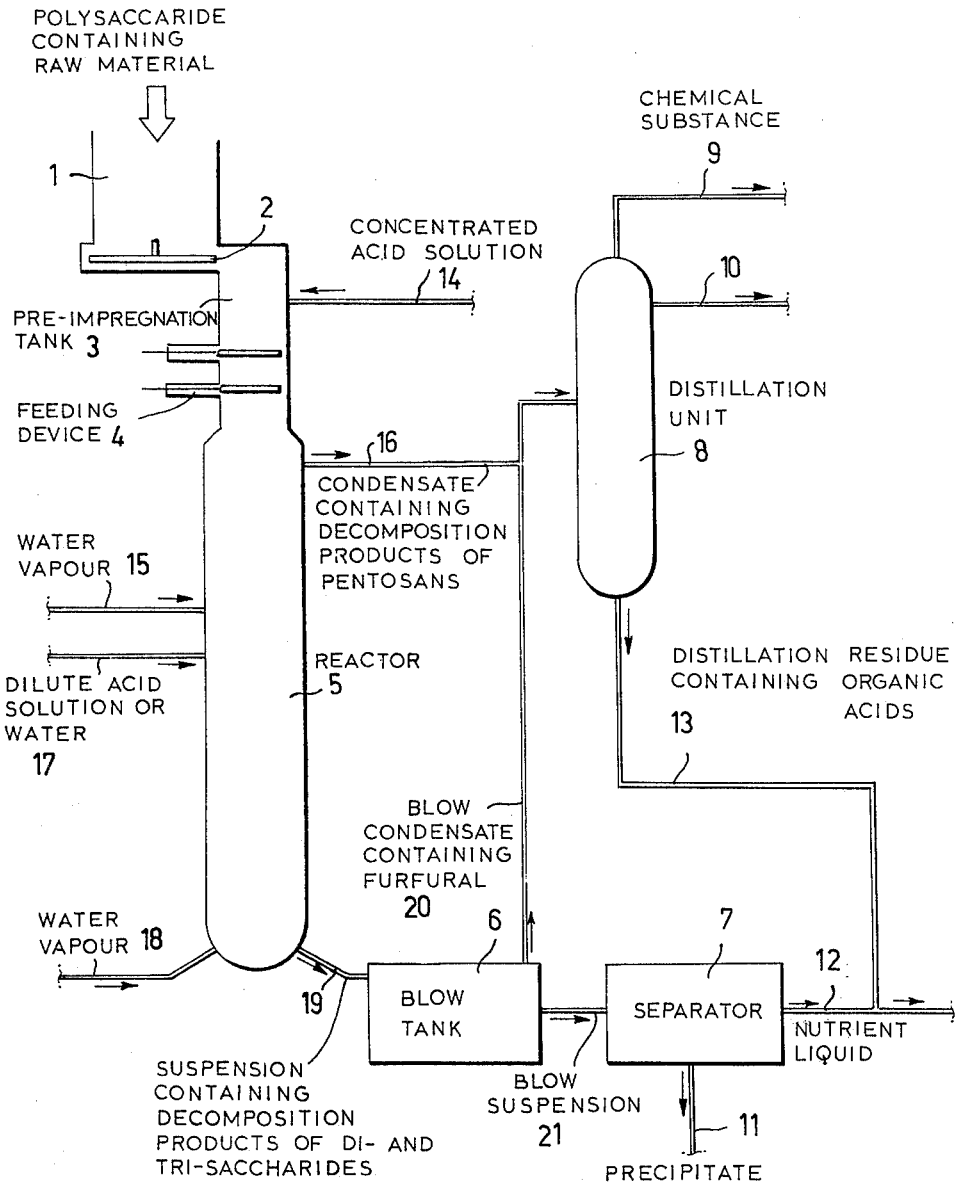
POLYSACCARIDE CONTAINING RAW MATERIAL
1
2
PRE-IMPREGNATION TANK 3
FEEDING DEVICE 4
CONCENTRATED ACID SOLUTION
14
CHEMICAL SUBSTANCE
9
10
DISTILLATION UNIT
8
16
CONDENSATE CONTAINING DECOMPOSITION PRODUCTS OF PENTOSANS
WATER VAPOUR 15
DILUTE ACID SOLUTION OR WATER
17
REACTOR
5
DISTILLATION RESIDUE CONTAINING ORGANIC ACIDS
13
BLOW CONDENSATE CONTAINING FURFURAL
20
WATER VAPOUR 18
6
7
12
19
BLOW TANK
SEPARATOR
NUTRIENT LIQUID
SUSPENSION CONTAINING DECOMPOSITION PRODUCTS OF DI- AND TRI-SACCHARIDES
BLOW SUSPENSION
21
11
PRECIPITATE

ACID HYDROLYSIS OF POLYSACCHARIDE-CONTAINING RAW MATERIAL

The subject of the present invention is a continous method for the decomposition of a raw-material that contains polysaccharides under pressure and elevated temperature by means of acid hydrolysis for raw-materials of chemical and microbiological industry, as well as for recovery of same. The method is accomplished by using a two-step hydrolysis, wherein in the first step, in a vapour phase, by the effect of a concentrated acid, the hexosans of the polysaccharides are decomposed into disaccharides and trisaccharides and the pentosans are decomposed mainly into furfural, methanol, and acetic acid, and in the second step, by the effect of a dilute acid, in a liquid phase, the disaccharides and trisaccharides are decomposed into monosaccharides and into saccharic and fatty acids.

At present, wood-chemical research is increasingly directed at the discovery of methods in which at present unused resources of raw-material are put into use. One such method is the decomposition of a raw-material that contains polysaccharides into various chemical compounds that constitute raw-materials for the chemical and microbiological industry. This decomposition can be carried out by means of acid hydrolysis, whereby the polysaccharides are hydrolysed and decomposed into different products, such as furfural, acetone, methanol, and acetic acid, which are suitable for raw-materials of the chemical industry, and fatty acids and monosaccharides, which are suitable for raw-materials of the microbiological industry. What then remains of lignin-containing raw-materials is the sulphur-free lignin sediment, which is also suitable for raw-material, for example for glue and plastics industry. This lignin sediment is as dried, as such, already suitable for use as additive in the present plywood and particle board glues.

In order to perform this acid hydrolysis, a number of different methods have been developed, which methods have the common feature that they are batch methods which use either concentrated or dilute mineral acid as catalyst. There are also batch methods, for example in the USSR, in which the hydrolysis takes place in two steps so that in the first step only a vapour hydrolysis takes place whereby the pentosans are hydrolysed into furfural, acetic acid, methanol, and acetone, and in a hydrolysis performed in the second step by dilute acid the hexosans are decomposed into monosaccharides and into saccharic and fatty acids. The best-know processes are the Rheinau process, which uses concentrated hydrochloric acid, and the Scholler process, which uses dilute sulphuric acid, both of which operate periodic by using percolation. As far as we know, besides the Rheinau process, there are no other processes using concentrated acid in industrial use. There are several methods that use dilute acid, all of which are adaptations of the Scholler process.

The purpose of the present invention is continuous decompostion of the polysaccharides contained in a raw-material into different products, and this purpose is achieved by means of the method in accordance with the invention, which is mainly characterized in that the raw-material that contains polysaccharides is hydrolysed continuously in one reactor as two steps so that, in the first step, the hydrolysis is run in the upper part of the reactor in a vapour phase by the effect of concentrated acid and water vapour, whereby the pentosans are decomposed mainly into furfural, acetic acid, methanol, and acetone, and the hexosans are decomposed into disaccharides and trisaccharides, and in the second step the hydrolysis is run in the bottom part of the reactor in a liquid phase by the effect of dilute acid and water vapour, whereby the disaccharides and trisaccharides obtained in the first step are decomposed into monosaccharides and into saccharic and fatty acids.

By means of the procedure in accordance with the invention, it has been noticed that the following advantages are obtained as compared with the known level of technology: The previous batch methods are, as periodical, rather complicated and slow to run as well as uneconomical, owing to the fact that thereby only part of the polysaccharides are decomposed into the final products in one hydrolysis, for which reason the number of hydrolyses and, accordingly, hydrolysis reactors may be up to 20 .

When the hydrolysis is run by using concentrated acid, the polysaccharides can be made to decompose only to the level of disaccharides and trisaccharides, so that, besides the hydrolysis using concentrated acid, a hydrolysis by dilute acid is also required in order to obtain the final reaction product. By means of the procedure in accordance with the present invention, the final products are obtained in one reactor.

When a normal pentosan hydrolysis is performed on the raw-material by means of water vapour alone, the yield of furfural is lower than when acid is used as a catalyst in the hydrolysis. By means of the procedure in accordance with the invention, this is achieved in the first step.

When the hydrolysis is performed as a two-step process so that in the first step only mere pentosan hydrolysis by water vapour takes place and in the second step an acid hydrolysis by dilute acid, the delay times are both in the pentosan-hydrolysis and in the acid-hydrolysis reactors remarkably long as compared with the procedure in accordance with the present invention. This results from the fact that extracted materials possibly contained in the raw-material, together with furfural, by the effect of water vapour under pressure, are polymerized and form a film on the surface of the raw-material, which retards the taking place of the hydrolysis reaction at both steps. When the hydrolysis is performed by means of the procedure in accordance with the present invention, the formation of the polymer film is prevented and does not retard the hydrolysis, whereby the delay time becomes shorter. p As raw-materials for the process in accordance with the present invention are suitable all commonest raw-materials that contain polysaccharides, such as ordinary chips of hardwood and conifer, chips of small trees of hardwood and conifer, mixtures of the above, straw, turf, bagasse, polysaccharide-containing waste of food industry, such as the mash from breweries and the potato jackets.

In a specific embodiment of the method in accordance with the invention, as the raw-material are used wood chips from which so called extractives have been removed by treatment with a chemical solvent. Hereby it has been noticed that the hydrolysis can be performed with an even shorter delay time, whereby the monosaccharide yield also increases as a result of the fact that the monosaccharides formed do not have time to be decomposed into different decomposition products, such as levulinic and formic acids.

The invention will be described more in detail below with reference to the attached diagram, which shows an embodiment of the method in accordance with the invention.

The raw-material is supplied from a silo 1 by a screw or disk feeder 2 into a pre-impregnation tank 3, in which it is moistened by a concentrated acid solution 14. According to our experience, an acid of more than 10 percent by weight can be considered as concentrated and one of lower concentration as dilute. As the acid it is possible to use any mineral acid whatsoever, even though it is obvious that the higher the boiling point of the acid is, the more advantageous and economical it is for use in the process. It is also possible to use combinations of different acids in the process. On the basis of present experience, sulphuric acid is obviously the most practical one, because its boiling point is high and its technical handling in this process easiest. More readily evaporating acids pass in the process into the gas phase and leave the process more easily, for example, with the condensates and have a detrimental effect on further processes. From the pre-impregnation tank 3 the raw-material is passed through a feeding device 4 operating by the rotation or gate principle into the reactor 5. As an alternative to treating the raw material with concentrated acid before it is supplied to the reactor, concentrated acid may be fed into the upper part of the reactor. In the upper part of the reactor the raw-material, as subject to pressure and temperature, becomes in the vapour phase subject to the effect of water vapour 15 supplied into the reactor from the bottom part of the vapour phase, whereby pentosan hydrolysis takes place nd a condensate containing furfural, acetic acid, methanol, and acetone is obtained as the result, which condensate 16 is passed out from the upper part of the vapour phase. The hexosans contained in the raw-material, which have been decomposed into disaccharides and trisaccharides during the pentosan hydrolysis, decomposed in the bottom part of the reactor in the liquid phase into monosaccharides and into saccharic and fatty acids. A dilute acid solution or water 17 is supplied into the upper part of the liquid phase and vapour 18 is supplied into its lower part. The suspension 19 obtained as the result of decomposition is pushed from the reactor 5 into a blow tank 6, the blow condensates 20 produced in which and containing furfural are condensed and combined with the condensates 16 passed out from the upper part of the reactor 5 as well as distilled in the distillation unit 8 so as to recover the chemical substances 9 and 10 in the condensates. The suspension 21 in the blow tank 6 is passed into precipitate separation 7, where the precipitate 11 possibly contained in the suspension is separated. The remaining nutrient liquid 12 is removed for use. The distillation residue 13 remaining from the distillation unit 8 and containing organic acids can be combined with said nutrient liquid 12. The liquid to be passed into the liquid phase can be fed into the reactor at several points along the liquid phase, and so can the passing-out of the liquid from the reactor be arranged at several points along the liquid phase, whereby the efficiency of the hydrolysis can be increased.

EXAMPLE 1

Using a 300 liter continuous hydrolysis reactor as the equipment, the hydrolysis was run on wood chips of small birch whose cellulose content was 72 percent and humidity 15 percent, as follows. The chips were moistened with concentrated sulphuric acid, whose quantity was 5 percent of the dry substance of the chips, and were immediately supplied into the reactor. At the middle of the reactor, vapour was fed in so that the temperature in the reactor was 185° C and the pressure 11 kg/cm$^2$ gauge pressure. Condensate was taken out at the upper part of the reactor. At the middle of the reactor, underneath the vapour supply, water was fed into the reactor so that the liquid quantity, including the moisture of the raw-material, was 4 m$^3$ per dry ton of chips. At the bottom part of the reactor, vapour was fed into the reactor in order to maintain the temperature and the pressure after the addition of water. The obtained mixture was removed from the bottom part of the reactor along a blow pipe into the blow tank by means of the difference in pressure between the reactor and the blow tank. The delay time of the raw-material in the vapour phase was 30 minutes and in the liquid phase 30 minutes. Of the cellulose contained in the raw-material, 91.1 percent were decomposed hereby, and as the reaction result were obtained 16.9 percent of furfural, 12.2 percent of organic acids, and 20.5 percent of monosaccharides as calculated from the quantity of cellulose in the raw-material.

EXAMPLE 2

A hydrolysis in accordance with example 1 was performed by using as the raw-material chips of small birch, from which the extracted materials had been removed by a chemical solvent. Now 81.4 percent of the cellulose contained in the chips were decomposed, and as results of reaction were obtained 21.2 percent of furfural, 12.1 percent of organic acids, and 26.5 percent of monosaccharides as calculated from the quantity of cellulose in the raw-material.

EXAMPLE 3

A hydrolysis in accordance with example 1 was performed by using as the raw-material the extract residue of sugar cane, i.e. bagasse, whose cellulose content was 60.4 percent. Hereby 82.7 percent of the cellulose in the raw-material were decomposed, and as reaction results were obtained 25.4 percent of furfural 22.3 percent of organic acids, and 25.0 percent of monosaccharides as calculated from the quantity of cellulose in the raw material.

What we claim is:

1. A continuous method for the decomposition of a raw material containing polysaccharides under pressure and elevated temperature by means of acid hydrolysis into raw materials of chemical and microbiological industry, as well as for recovery of same, said method comprising hydrolyzing the raw material containing polysaccharides continuously in one reactor as two steps, in the first step the hydrolysis being carried out in the upper part of the reactor in a vapor phase, and in the second step the hydrolysis being carried out in the bottom part of the reactor in a liquid phase, said steps being performed by:

a. impregnating the raw-material with a concentrated acid and supplying the impregnated raw-material into the reactor, b. supplying water vapor into the bottom part of the vapor phase, and by the effect of the concentrated acid and water vapor decomposing pentosans into furfural, acetic acid, methanol, and acetone, and decomposing hexosans into disaccharides and trisaccharides, c. from the upper part of the vapor phase removing a condensate containing the mentioned decomposition products of pentosan, d. feeding a dilute acid solution into the upper part of the liquid phase and feeding water vapor into the bottom part of the liquid phase, and by the effect of the dilute acid and water vapor decomposing the disaccharides and trisaccharides obtained in the first step into monosaccharides and into saccharic and fatty acids, and e. removing from the liquid phase a liquid containing the mentioned decomposition products of disaccharides and trisaccharides.

2. A method as claimed in claim 1, wherein a dilute acid solution is fed into the reactor at several points along the liquid phase.

3. A method as claimed in claim 1, wherein liquid is removed from the reactor at several points along the liquid phase.

4. A method as claimed in claim l, wherein the raw material that contains polysaccharides is, before feeding into the reactor, pre-treated by an organic solvent so as to remove the extracted materials.

5. A continuous method for the decomposition of a raw material containing polysaccharides under pressure and elevated temperature by means of acid hydrolysis into raw materials of chemical and microbiological industry, as well as for recovery of same, said method comprising hydrolyzing the raw material containing polysaccharides continuously in one reactor as two steps, in the first step the hydrolysis being carried out in the upper part of the reactor in a vapor phase, and in the second step the hydrolysis being carried out in the bottom part of the reactor in a liquid phase, said steps being performed by:

a. supplying the raw material and a concentrated acid solution into the reactor, b. supplying water vapor into the bottom part of the vapor phase, and by the effect of the concentrated acid and water vapor decomposing the pentosans into furfural, acetic acid, methanol, and acetone, and decomposing hexosans into disaccharides and trisaccharides , c. from the upper part of the vapor phase removing a condensate containing the mentioned decomposition products of pentosans, d. feeding a dilute acid solution into the upper part of the liquid phase and feeding water vapor into the bottom part of the liquid phase, and by the effect of the dilute acid and water vapor decomposing the disaccharides and trisaccharides obtained in the first step into monosaccharides and into saccharic and fatty acids, and e. removing from the liquid phase a liquid containing the mentioned decomposition products of disaccharides and trisaccharides.

6. A continuous method for the decomposition of a raw material containing polysaccharides under pressure and elevated temperature by means of acid hydrolysis into raw materials of chemical and microbiological industry, as well as for recovery of same, said method comprising hydrolyzing the raw material containing polysaccharides continuously in one reactor as two steps, in the first step the hydrolysis being carried out in the upper part of the reactor in a vapor phase, and in the second step the hydrolysis being carried out in the bottom part of the reactor in a liquid phase, said steps being performed by:

a. impregnating the raw material with a concentrated acid and supplying the impregnated raw-material into the reactor, b. supplying water vapor into the bottom part of the vapor phase, and by the effect of the concentrated acid and water vapor decomposing pentosans into furfural, acetic acid, methanol, and acetone, and decomposing hexosans into disaccharides and trisaccharides, c. from the upper part of the vapor phase removing a condensate containing the mentioned decomposition products of pentosans, d. feeding water into the upper part of the liquid phase and feeding water vapor into the bottom part of the liquid phase, and by the effect of dilute acid and water vapor decomposing the disaccharides and trisaccharides obtained on the first step into monosaccharides and into saccharic and fatty acids, and e. removing the liquid phase a liquid containing the mentioned decomposition products of disaccharides and trisaccharides.

7. A method as claimed in claim 6, wherein water is fed into the reactor at several points along the liquid phase.

* * * * *